United States Patent [19]
Horowitz et al.
[11] 4,243,513
[45] Jan. 6, 1981

[54] METHOD OF INCREASING YIELD OF PETROLEUM PITCH

[75] Inventors: Samuel I. Haywood, Bakersfield, Calif.; Henry T. Ingram, Roselle, N.J.

[73] Assignee: Witco Chemical Corporation, New York, N.Y.

[21] Appl. No.: 630,850

[22] Filed: Nov. 10, 1975

[51] Int. Cl.[3] ..... C10G 37/06
[52] U.S. Cl. ..... 208/44
[58] Field of Search ..... 208/41, 42, 43, 22, 208/39, 40, 44

[56] References Cited

U.S. PATENT DOCUMENTS

| | | | |
|---|---|---|---|
| 2,992,181 | 7/1961 | Renner | 208/22 |
| 3,288,701 | 11/1966 | Fauber et al. | 208/22 |
| 3,318,801 | 5/1967 | Alexander et al. | 208/22 |
| 3,355,377 | 11/1967 | King | 208/41 |
| 4,017,378 | 4/1977 | Fauveau et al. | 208/44 |

*Primary Examiner*—O. R. Vertiz
*Assistant Examiner*—Wayne A. Langel
*Attorney, Agent, or Firm*—Albert L. Gazzola; Morton Friedman

[57] ABSTRACT

Clarified slurry oil feedstock is heated at temperatures above 340° C. and preferably between 390° C. and 410° C. for periods exceeding a minimum of about 2 hours, under reflux conditions and in the absence of air, so as to maximize the polymerization of light ends in the formation of petroleum pitch. An increased yield of petroleum pitch is obtained from the clarified slurry oil feedstock.

2 Claims, No Drawings

METHOD OF INCREASING YIELD OF PETROLEUM PITCH

This invention relates to a method of producing petroleum pitch. Specifically, this invention relates to a method of increasing the yield of petroleum pitch from clarified slurry or decant oil feedstock.

Heretofore petroleum pitch was produced by polymerizing clarified slurry oil in the presence of air at temperatures in excess of 680° F. (360° C.). Such prior art processes produced a relatively low yield of petroleum pitch with relatively excessive amounts of distillate by-product.

U.S. Pat. No. 3,725,240 issued to Baum in April 1973, for instance, discloses a method of producing petroleum pitch by subjecting the high boiling oil of catalytically cracked petroleum gas oil to temperatures of 750° F. to 850° F. (398° C. to 455° C.) in the presence of a continuous flow of air for periods not exceeding 1 hour.

Now it has been found, quite unexpectedly, that increased yields of petroleum pitch from clarified slurry oils are obtainable by refluxing the clarified slurry oil in the absence of air with a minimum of coke formation.

It is therefore an object of this invention to provide a method of producing petroleum pitch from clarified slurry oil.

It is a further object of this invention to increase the yield of petroleum pitch heretofore obtainable from clarified slurry oils.

It is still a further object of this invention to produce petroleum pitch from clarified slurry oil in the absence of air, and more particularly in the absence of a continuous flow of air.

The exclusion of air or oxygen, by the present process, not only affords the advantage of increased yields of pitch with reduced cost of operation, but also precludes the incidence of fire or explosion attributable to the presence of oxygen.

The present invention provides a novel process of refluxing clarified slurry oil feedstock in the absence of air or oxygen at temperatures of from about 340° C. (644° F.) to about 430° C. (806° F.) for periods of at least about 2 hours. Preferably the temperature range is between 390° C. and 410° C. and the heating is from about 2 to about 10 hours. Heating beyond 10 hours provides no additional advantage.

The aforementioned feedstock, may comprise stocks obtained from Fluid Catalytic Cracking (FCC) operations or Thermoform Catalytic Cracking (TCC) operations. In the FCC operation, in general, preheated gas oil is charged to a reactor inlet line, where it picks up finely divided (e.g. 100 mesh) regenerated catalyst from the regenerator-catalyst standpipe and carries it into the reactor. Sensible heat of the gas oil charge plus sensible heat of hot catalyst from regeneration at temperatures upwards of 1200° F. supply sufficient heat that the endothermic cracking reaction is sustained at a desired temperature. The upward flow of hydrocarbons in the FCC reactor is adjusted to maintain a fludized bed of the finely divided catalyst, promoting contact between catalyst and charge. In a typical operation for preparing feedstock, California heavy gas oil (650° F.–1000° F.) is converted over a zeolite catalyst such as that described in U.S. Pat. No. 3,140,249 issued to Plank et al. in July 1964, in an FCC operation at 950° F.–975° F., a weight hourly space velocity of 11 and catalyst to oil ratio of 8. Reaction products are then passed into a distillation column, in the bottom section of which they are quenched to about 600° F. to condense the heaviest hydrocarbons. Quenching is accomplished by circulating heavy condensate through a cooler and then back through the bottoms section of the column, and the circulating condensate scrubs catalyst fines out of the upflowing reaction products. The catalyst slurry so produced is sent to a settler to concentrate the catalyst, the concentrated bottoms being returned to the reactor. The oil separated from the concentrated bottoms, hereinafter and hereinbefore "clarified oil", or "clarified slurry oil", is a source of basic raw material for the process of this invention.

The above invention is more fully described in the following examples:

EXAMPLE I

A clarified slurry having the analysis shown in Table 1, below, is refluxed for 9 hours at temperatures of 380° C. to 410° C. in the absence of air.

Table 1

| | |
|---|---|
| Specific Gravity 60° F./60° F. | 1.13 |
| Flash Point (COC) | 375° F. |
| Distillation: | |
| 0–235° C. | 0.1% |
| 0–270° C. | 0.3% |
| 0–300° C. | 1.0% |
| 0–360° C. | 5.6% |
| 0–400° C. | 14.6% |

The above process yields 74.2 percent by weight of a pitch having the analysis as shown in Table 2.

Table 2

| | |
|---|---|
| Softening Point, Mettler | 84° C. |
| Specific Gravity 60° F./60° F. | 1.27 |
| Distillation: | |
| 0–360° C. | 0% |
| 0–400° C. | 3.1% |

Prior art methods generally provided yields of petroleum pitch from similar clarified slurry oil, of about 45 percent by weight based on the weight of clarified slurry oil.

EXAMPLE II

The procedure of Example I is repeated, except that the clarified slurry oil is refluxed in the absence of air for 7 hours at temperatures of 390° C.–410° C.

This process yields an 81.9 percent by weight of petroleum pitch having the analysis shown in Table 3.

Table 3

| | |
|---|---|
| Softening Point, Mettler | 85° C. |
| Specific Gravity 60° F./60° F. | 1.27 |
| Distillation: | |
| 0–360° C. | 0% |
| 0–400° C. | 9.1% |

As aforesaid, prior art methods, where air or oxygen is utilized, generally provides yields of petroleum pitch from similar clarified slurry oil, of about 45% by weight based on the weight of clarified oil.

The present petroleum pitch product generally has a Mettler Softening Point of about 70° C.–130° C., and preferably between 80° C.–90° C. for use as a binder pitch for carbon electrodes.

Pursuant to this invention the relatively mild refluxing conditions are performed continuously for several hours, in the absence of air. Expected yields pursuant to this invention are generally above 70% by weight, and in most cases above 75% by weight based on the weight of feedstock.

It is of course to be understood that the terms, "absence of air" as used hereinbefore and hereinafter refer in the more general sense to the "absence of oxygen or oxygen containing gas" such as air, inert gases and oxygen mixtures, such as nitrogen-oxygen, argon-oxygen, and the like.

The catalytic cycle stock derived from either FCC or TCC as described above will have an initial boiling point determined by the nature of the refinery operation, generally determined by factors other than manufacture of binder pitch. If the fractionation be so conducted as to provide a cycle stock of low initial boiling point, as in operations for maximum gasoline, the cycle stock may be refractionated apart from the main fractionated apart from the main fractionation of the cracking unit. In general, the cycle stock processed according to this invention will substantially boil under atmospheric conditions above about 400° C.

From the foregoing data and disclosure, it will be noted that the present invention makes possible the formation of increased yields of petroleum pitch from clarified slurry oil feedstock. The petroleum pitch produced by the process of this invention is mainly used as a binder pitch in the manufacture of carbon electrodes, but has application generally as a binder pitch as known in the art.

Although the present invention has been described with preferred embodiments, it will be understood that various modifications and adaptations thereof may be resorted to, without departing from the spirit and scope of the invention, as those skilled in the art will appreiciate.

What is claimed is:

1. A process for making petroleum pitch from clarified slurry oil comprising refluxing the clarified slurry oil in the absence of air at temperatures from about 390° C. to about 410° C. for a period of from about 2 to about 10 hours whereby above 70% by weight of petroleum pitch based on the weight of clarified slurry oil is recovered, said pitch having a Mettler Softening Point in the range of about 70°–130° C.

2. The process of claim 1, wherein the clarified slurry oil substantially boils at about 400° C. under atmospheric conditions.

* * * * *